US005731753A

United States Patent [19]

Block

[11] Patent Number: 5,731,753

[45] Date of Patent: Mar. 24, 1998

[54] CERAMIC RESONATOR, FOR MICROWAVE CERAMIC FILTERS, HAVING AT LEAST ONE CHAMFER WHICH PROVIDES FOR OVERTONE SUPPRESSION

[75] Inventor: Christian Block, Graz, Austria

[73] Assignee: Siemens Matsushita Comp. GmbH & Co. KG, Munich, Germany

[21] Appl. No.: 638,092

[22] Filed: Apr. 25, 1996

Related U.S. Application Data

[63] Continuation of Ser. No. 257,369, Jun. 9, 1994, abandoned.

[30] Foreign Application Priority Data

Jun. 9, 1993 [DE] Germany ..... 43 19 242.4

[51] Int. Cl.[6] ..... H01P 7/04

[52] U.S. Cl. ..... 333/222; 333/202; 333/206

[58] Field of Search ..... 333/202, 206, 333/207, 222, 223, 235

[56] References Cited

U.S. PATENT DOCUMENTS

| | | | |
|---|---|---|---|
| 4,733,208 | 3/1988 | Ishikawa et al. | 333/206 |
| 5,045,824 | 9/1991 | Metroka | 333/206 |
| 5,144,269 | 9/1992 | Itoh | 333/206 |
| 5,208,566 | 5/1993 | Kenoun et al. | 333/206 |
| 5,327,109 | 7/1994 | Hoang et al. | 333/206 |

FOREIGN PATENT DOCUMENTS

| | | | |
|---|---|---|---|
| 0208424 | 1/1987 | European Pat. Off. | 333/206 |
| 3529810 | 3/1986 | Germany . | |
| 0278702 | 10/1992 | Japan | 333/202 |
| 0085503 | 3/1994 | Japan | 333/222 |

OTHER PUBLICATIONS

Patent Abstracts of Japan, vol. 11, No. 154 [E–508],May 19, 1987 & JP–A–60–133776 (Matsuo) Jun. 19, 1985.

Patent Abstracts of Japan, vol. 16, No. 412 [E–1256], Aug. 31, 1992 & JP–A–2–260985 (Matsushita) Sep. 1990.

Hano et al., IEEE Transactions on Microwave Theory and Techniques, vol. MTT–34, No. 9, Sep. 1986 pp. 972–976.

*Primary Examiner*—Benny Lee

*Attorney, Agent, or Firm*—Herbert L. Lerner; Laurence A. Greenberg

[57] ABSTRACT

A ceramic resonator for microwave ceramic filters includes a ceramic body having a predetermined form with surfaces and edges. The ceramic body has an internal conductor bore formed therein and is metallized on all of the surfaces except for at least one at least partially unmetallized surface. One of the surfaces has an aperture window formed therein for coupling to other ceramic resonators to form a microwave ceramic filter. At least one of the edges has a chamfer formed thereon.

2 Claims, 1 Drawing Sheet

CERAMIC RESONATOR, FOR MICROWAVE CERAMIC FILTERS, HAVING AT LEAST ONE CHAMFER WHICH PROVIDES FOR OVERTONE SUPPRESSION

This application is a continuation, of application Ser. No. 08/257,369, filed Jun. 9, 1994, now abandoned.

BACKGROUND OF THE INVENTION

The present invention relates to a ceramic resonator for a microwave ceramic filter, having a ceramic body with a predetermined form, containing an internal conductor bore and being metallized on all sides, except for at least one at least partially unmetallized surface, and one surface having an aperture window for coupling to other ceramic resonators to form a microwave ceramic filter.

One such ceramic resonator has a ceramic body in which an internal conductor bore is provided. The ceramic body is metallized on all sides, including the inner surface of the internal conductor bore, except for a partially unmetallized surface for a shortening capacitor and a surface portion forming an aperture window. The shortening capacitor is formed in the region of the internal conductor bore by means of a metallized surface region, and the metallizing is joined to the metallizing on the inside of the internal conductor bore. A metallizing-free aperture window is also provided in one surface of the resonator and it serves to couple the resonator to a corresponding aperture window in a respective further ceramic resonator in a microwave ceramic filter.

Particularly for housingless SMD microwave ceramic filters, a coupling structure may be provided on a further surface of the resonator. The coupling structure is formed by a metallized region being separated from the remainder of the metallization, and the resonator can be coupled to an HF circuit in a microwave ceramic filter by means of the coupling structure.

Ceramic resonators and microwave ceramic filters formed thereby, of the type described generally above are known in principle, for instance from IEEE Transactions on Microwave Theory and Techniques, Vol. MTT-34, No. 9, Sep. 1986, pp. 972–976.

One problem in such ceramic resonators and microwave ceramic filters formed thereby is that in addition to the fundamental oscillations, overtones also occur. In filters that include coupled lambda/4 resonators, uneven multiples of the fundamental oscillation occur in the form of overtones. When such a microwave ceramic filter is used in an HF circuit, the overtones, being mixed products, can have a disruptive effect and must therefore be suppressed, which is expensive. Block-shaped filters, or filters made of block-shaped resonators, also have parasitic rectangular waveguide modes, which as a rule must also be suppressed.

SUMMARY OF THE INVENTION

It is accordingly an object of the invention to provide a ceramic resonator and a microwave ceramic filter formed thereby, which overcome the hereinafore-mentioned disadvantages of the heretofore-known devices of this general type and which do so in such a way that overtones are suppressed.

With the foregoing and other objects in view there is provided, in accordance with the invention, a ceramic resonator for microwave ceramic filters, comprising a ceramic body having a predetermined form with surfaces and edges; the ceramic body having an internal conductor bore formed therein and being metallized on all of the surfaces except for at least one at least partially unmetallized surface; one of the surfaces having an aperture window formed therein for coupling to other ceramic resonators to form a microwave ceramic filter; and at least one of the edges having a chamfer formed thereon.

In accordance with another feature of the invention, the surface having the aperture window formed therein has one edge being the edge having the chamfer formed thereon and an opposite edge toward which the aperture window is shifted outward.

In accordance with a concomitant feature of the invention, the surface having the aperture window formed therein has two opposed edges each being one of the at least one edge having the chamfer formed thereon.

Other features which are considered as characteristic for the invention are set forth in the appended claims.

Although the invention is illustrated and described herein as embodied in a ceramic resonator for microwave ceramic filters, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
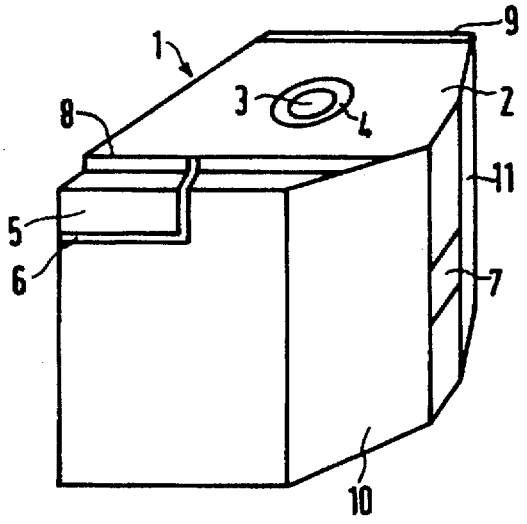
FIG. 1 is a diagrammatic perspective view of a first embodiment of a ceramic resonator according to the invention.

Referring now to the figures of the drawing in detail and first, particularly, to FIG. 1 thereof, there is seen an embodiment of a ceramic resonator according to the invention, having a ceramic body 1 which is originally constructed as being block-shaped. An internal conductor bore 3 is provided in this ceramic body 1 and is surrounded, on an otherwise metallizing-free surface 2, by a shortening capacitor 4 formed by a metallized surface region. Otherwise, the ceramic body is metallized on all sides, including the inner surface of the internal bore 3, except for a surface region 6 partitioning off a coupling structure 5 and except for an aperture window 7. One edge 8 forms a calibration edge for wave resistance adaptation and for rough calibration of the resonator frequency. A further edge 9 forms a calibration edge for fine frequency calibration and for frequency class calibration.

In order to suppress overtones, the invention makes use of the fact that geometric changes in the resonator can more or less severely change wave propagation. In the embodiment of FIG. 1, one respective chamfer 10, 11 is therefore provided on each of two opposed edges of a surface containing the aperture window 7.

Figure 2:
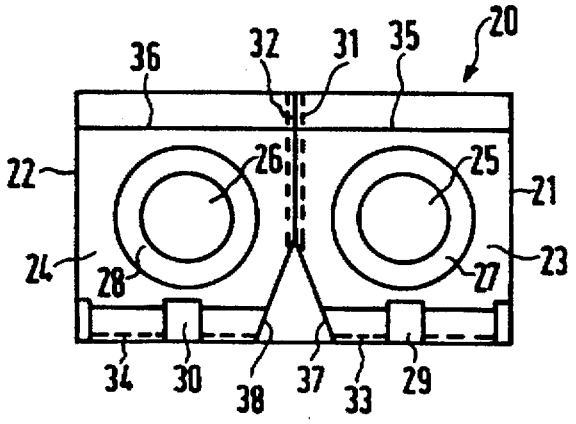
FIG. 2 is a plan view of a second embodiment of the ceramic resonator according to the invention and a microwave ceramic filter formed thereby.

FIG. 2 shows a further embodiment of ceramic resonators constructed according to the invention, which are coupled together to form a microwave ceramic filter 20. Corresponding to the embodiment of FIG. 1, two ceramic resonators are each formed by a respective ceramic body 21, 22 with an outer surface 23, 24, in which a respective internal conductor bore 25, 26 is surrounded by a shortening capacitor 27, 28. Corresponding to the embodiment of FIG. 1, a respective coupling structure 29, 30, an aperture window 31, 32 and calibration edges 33, 35 and 34, 36 are again provided.

However, in contrast to the embodiment of FIG. 1, a chamfer 37, 38 is provided on only one edge of the surfaces containing the aperture windows 31, 32. In this embodiment, the aperture windows 31, 32 are accordingly shifted outward, and because only one chamfer 37, 38 each is present, the result is an HF circuit, with a filter of the type described and shown, that is more easily assembled by the SMD method.

We claim:

1. A ceramic resonator for microwave ceramic filters, comprising:

a ceramic body having a predetermined form with surfaces and borders;

said ceramic body having an internal conductor bore disposed therein;

said surfaces including metallized surfaces, an at least partially metallized surface, and one surface having an aperture window disposed therein for coupling to other ceramic resonators to define a microwave ceramic filter; and one of said borders of said ceramic body being disposed with a chamfer extending from said one surface having said aperture window disposed therein to an adjacent surface for suppressing overtones by changing wave propagation.

2. The ceramic resonator according to claim 1, wherein said surface having said aperture window disposed therein has another border disposed opposite from said border with said chamfer, said other border having a chamfer disposed thereon for suppressing overtones by changing wave propagation and for assisting in assembling the filters.

* * * * *